United States Patent [19]

Kirchoff et al.

[11] 4,254,310

[45] Mar. 3, 1981

[54] SUBMINIATURE, MULTI-POLE TOGGLE SWITCH WITH LINEAR SEE-SAW CONTACTS

[75] Inventors: Francis D. Kirchoff, Waban; Ralph M. Manning, Winchester, both of Mass.

[73] Assignee: Alco Electronic Products, Inc., Andover, Mass.

[21] Appl. No.: 80,199

[22] Filed: Oct. 1, 1979

[51] Int. Cl.[3] ..... H01H 19/00

[52] U.S. Cl. ..... 200/6 R; 200/67 G; 200/153 LA

[58] Field of Search ..... 200/6 R, 6 A, 6 B, 6 BA, 200/6 BB, 6 C, 153 LA, 153 K, 67 G, 68

[56] References Cited

U.S. PATENT DOCUMENTS 3,715,534 2/1973 Piber ..... 200/57 G

*Primary Examiner*—J. V. Truhe
*Assistant Examiner*—Morris Ginsburg
*Attorney, Agent, or Firm*—Pearson & Pearson

[57] ABSTRACT

A multi-pole toggle switch achieves sub-miniature dimensions by mounting the four see-saw contacts, four stationary contacts and four actuating pads in two parallel, linear rows, each row on an opposite side of the path of the tip of the toggle lever plunger within the switch housing. A single actuator block carries the four pads and pressure is applied by a single spring from the plunger tip to the sliding block, then to the pads and then to the see-saw contacts. A depending tongue on the block slides in a groove in the base to form a moving insulation barrier between the rows of contacts.

6 Claims, 3 Drawing Figures

SUBMINIATURE, MULTI-POLE TOGGLE SWITCH WITH LINEAR SEE-SAW CONTACTS

BACKGROUND OF THE INVENTION

It has heretofore been proposed in U.S. Pat. No. 3,715,534 to Piber of Feb. 6, 1973 to provide a multi-pole toggle switch of miniature dimensions with four movable see-saw contacts arranged in parallelism with each other. To rock the two outboard, see-saw, movable contacts, a spring loaded plunger in the toggle lever is provided. To rock the two inboard see-saw movable contacts, a second spring of the leaf type is provided which apply pressure through two square insulating plungers.

SUMMARY OF THE INVENTION

It has been found that while a switch of miniature dimensions may be constructed as disclosed in the above mentioned Piper Patent, there is not sufficient available space within a switch of sub-miniature dimensions to permit the use of an extra leaf spring or to permit the use of fixed insulation barriers.

In this invention, therefore, sub-miniature dimensions have been achieved by departing from the four parallel see-saw contact teaching of the art and instead, arranging the see-saw contacts in two parallel, linear rows each on an opposite side of the path of the toggle lever plunger tip. Because there is insufficient space for the multiple parts used in prior art devices, actuation is achieved by a single actuator block mounted to slide longitudinally within the housing under pressure of the single spring of the plunger. Two parallel linear rows of pads are mounted on the actuator block, each in slidable engagement with one of the movable see-saw contacts to tilt the same so that spring pressure is transferred from the plunger tip to the center of the actuator block, and transferred equally to the pressure pads balance points and thence to the see-saw movable contacts. Because space is at a premium within the housing, a movable insulation barrier is provided consisting of an integral central depending tongue on the block which is slidably received in an elongated groove in the base to prevent short circuits between the linear rows of contacts.

DESCRIPTION OF THE PREFERRED EMBODIMENT

Figure 1:
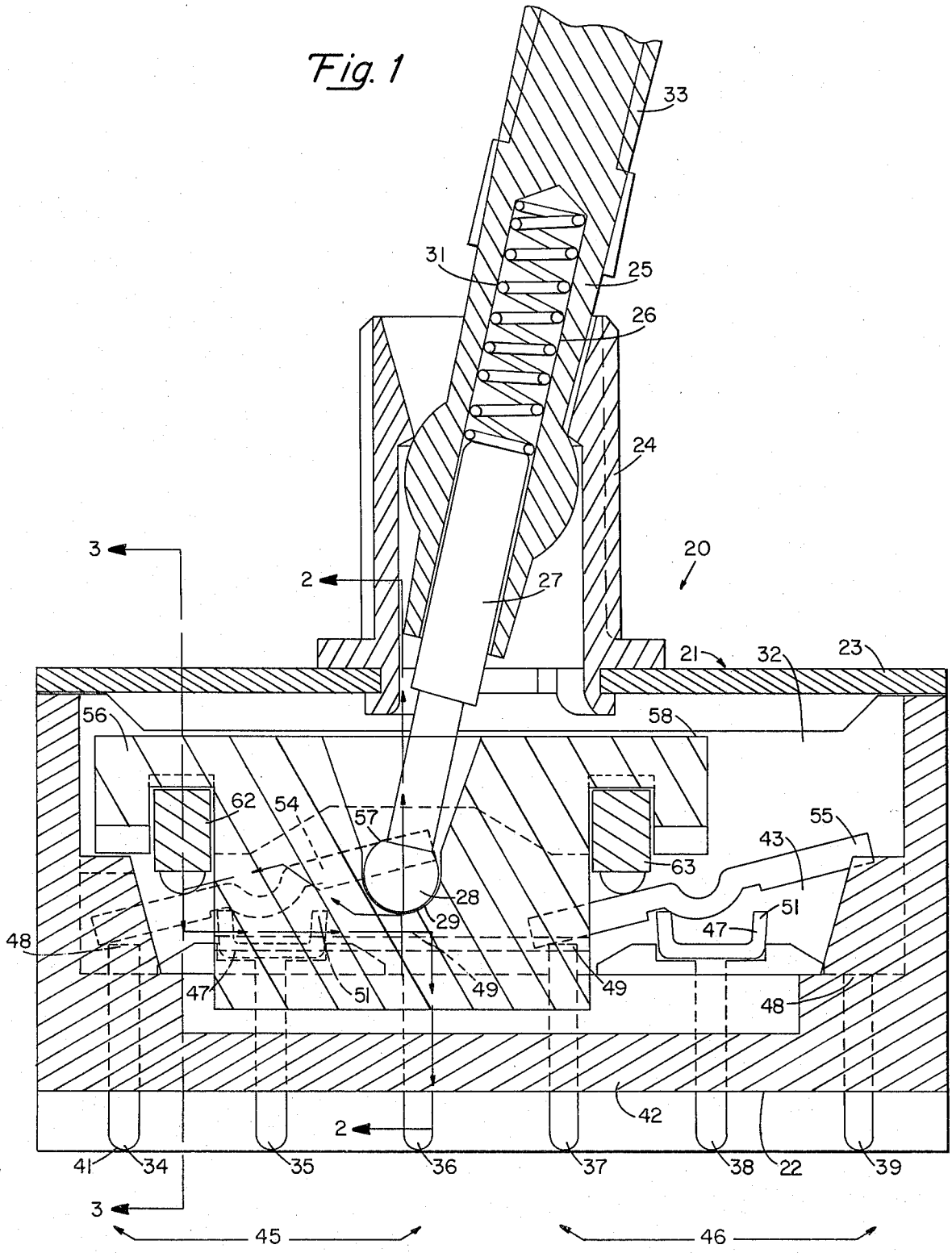
FIG. 1 is a side elevation, in half section of a multi-pole toggle switch of the invention.
Figure 2:
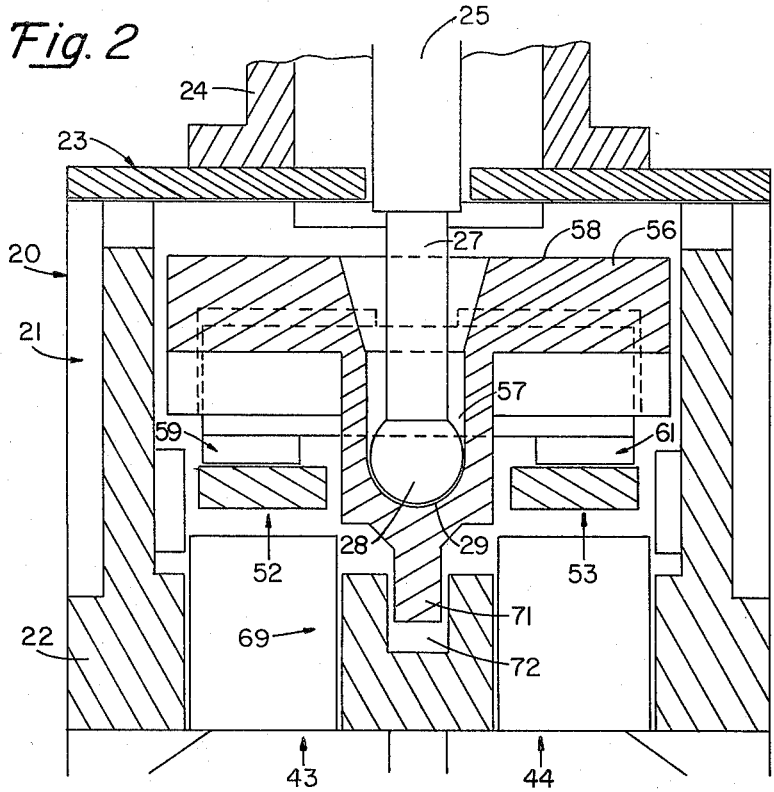
FIG. 2 is an end elevation, in section on line 2—2 of FIG. 1.

As shown in the drawing, a sub-miniature size, multi-pole, toggle switch 20 of the invention is of the movable see-saw, or rocker, contact type, and includes an elongated switch housing 21 formed by the base 22 and the elongated frame 23 secured to, and closing the top of the base. The metal frame 23 includes a bushing 24 with a toggle lever 25 mounted in the bushing for actuating the switch. The toggle lever 25 is thus pivotally supported in the bushing of the frame to move in a longitudinal path relative to the elongated switch housing 21.

Toggle lever 25 includes an internal bore 26 which slidably receives a plunger 27 so that the ball tip 28 at the inner end 29 of the lever is resiliently and yieldably continuously pressed downwardly by the helical coil compression spring 31, also seated within the bore 26. It will be seen that the ball tip 28 thus moves in a longitudinal path in the compartment 32, within housing 21, when the outer end, or finger grip 33 of the toggle lever 25 is moved.

A plurality of stationary contacts are mounted within the base 22, as at 34, 35, 36, 37, 38 and 39 each with an exposed terminal, such as 41, extending to the exterior through the bottom 42 for connection to an external circuit not shown because well known in the art. The stationary contacts are arranged in two parallel, linear rows 43 and 44, each row on an opposite side of the central, longitudinal path of the tip 28, one row being visible in FIG. 1 and the corresponding row being identical and in the half section of the switch not shown in FIG. 1.

Each linear row of contacts 43 or 44 is formed by two sets 45 and 46 of contacts and each set 45 or 46 of contacts includes an inboard contact 36, an outboard contact 34 and a central, see-saw support contact 35. Each central see-saw support contact 35 or 38 includes a cradle 47 at its inner end for rockably supporting a see-saw contact in a known manner, the inner ends 48 or 49 of the outboard and inboard contacts 34 and 36 being at a uniform predetermined level within the housing and the inner ends 51 of the cradles of the central contacts such as 35 and 38 being at a slightly higher predetermined level therewithin.

Two parallel linear rows 52 and 53 of movable see-saw contacts are provided, each on an opposite side of the path of the plunger tip 28 and each row 52 or 53 is formed by at least two see-saw contacts 54 and 55, each rockably seated in one of the cradles 47 of one of the central, see-saw support contacts such as at 35 and 38 in row of contacts 43. As shown in FIG. 1 all of the movable see-saw contacts such as 54 and 55, in each row 52 and 53 are tilted to contact a stationary contact such as 34 and 37 of their respective sets, to complete a circuit with their respective contacts 35 and 38. When simultaneously tilted to a neutral position, no circuit is completed and when tilted to contact the other stationary contacts 36 and 39 of the sets, other circuits are closed.

Figure 3:
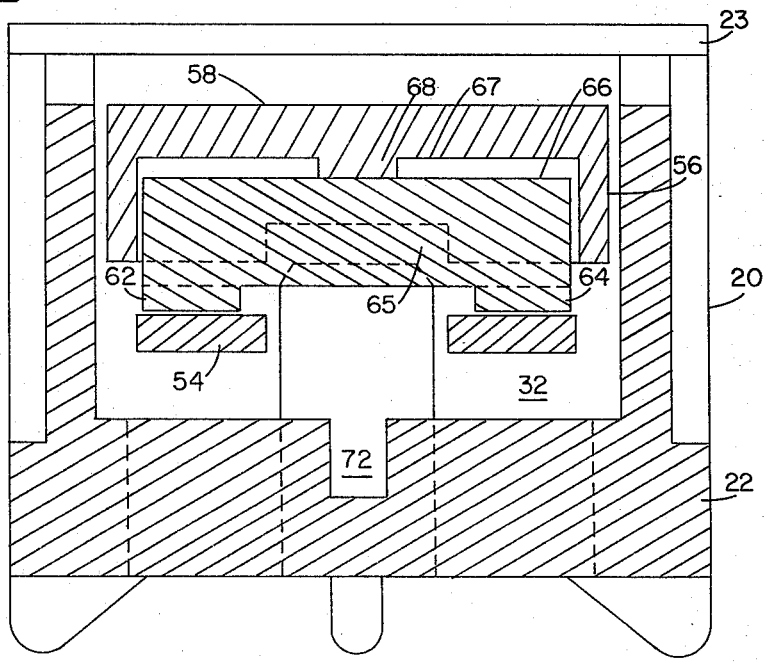
FIG. 3 is an end elevation in section on line 3—3 of FIG. 1.

In this invention an actuator block 56 is mounted within housing 21 to slide longitudinally therewithin under the influence of the spring biased ball tip 28 received in a centrally disposed ball socket 57 in the upper face 58 of the block. Actuator block 56 is provided with two parallel, linear rows 59 and 61 of actuator pads, each row on an opposite side of the longitudinal path of tip 28 and each row including at least two actuator pads such as at 62 and 63. Each pad such as 62 or 63 is in sliding engagement with one of the movable see-saw contacts such as 54 or 55, to tilt, or rock, the same from one stationary contact of its set to the other. Preferably, as best shown in FIG. 3, each pair of pads 62 on one side of one end of the block and 64 on the other side of the same end of the block are integral and formed of one piece 65 of transversely extending material loosely and slidably received in a transversely extending groove 66 in the underface 67 of actuator block 56. Thus, the pressure force exerted on block 56 by spring biased tip 28, is transferred by the block through the central pressure pad pivot point 68 equally to the see-saw movable contacts at each opposite end of the block.

Moving insulation barrier means 69 is provided within housing 21 and consisting of an integral, elongated, depending tongue 71 on actuator block 56, the tongue 71 being slidably received in a longitudinally extending central groove 72 in the bottom 42 of the base 22. The tongue 71 and groove 72 are of the insulative material of the base and overlap each other to form a moving insulative barrier which isolates adjacent moving contacts of the switch to avoid short circuiting and electrical flash over. It should be noted that transverse, insulation barriers between transversely extending see-saw contacts of the prior art would prevent the use of longitudinal see-saw contacts and longitudinal sliding actuators as disclosed herein. The isolating contact barrier is therefore combined with the movable slidable actuator member and, in addition, it provides mechanical guidance for the slidable actuator.

It is within the scope of this invention to provide more parallel, linear rows of see-saw contacts and to provide more see-saw contacts and stationary contacts in each row, four having been illustrated and described for the purpose of illustration and not in any way intended to limit the scope of the invention.

We claim:

1. A multi-pole toggle switch of sub-miniature dimensions, and of the movable see-saw contact type, said switch comprising:

an elongated insulating base;

an elongated frame secured to said base;

a toggle lever pivotally supported on said frame with its inner end, inside said switch, arranged to move in a longitudinal path therewithin;

stationary contacts mounted in said base and having terminals extending to the exterior thereof for connection to an external circuit, said contacts arranged in two parallel, linear rows, each row on an opposite side of said path, and each row comprising two sets of said contacts each set including an inboard contact, an outboard contact, and a central see-saw support contact therebetween;

two parallel, linear, rows of movable, see-saw contacts, each row on an opposite side of said path, each see-saw contact seated in one of said central see-saw support contacts and each arranged to be rocked into engagement with either the inboard or the outboard contact of its set to complete electrical connections therebetween;

an elongated actuator block, mounted to slide longitudinally within said switch, said actuator block including two linear, parallel rows of pads, each row on an opposite side of said path and each pad in sliding engagement with one of said see-saw contacts to rockably switch the contacts of its set;

and a spring pressed plunger within said toggle lever, having a tip in contact with the center of said actuator block, said tip transferring spring pressure to said block, thence to said pads and thence to said see-saw contacts.

2. A multi-pole toggle switch as specified in claim 1 wherein:

said elongated actuator block includes a pair of laterally extending grooves in the under face thereof, each proximate one of the opposite ends of the block;

and the two pads at the same end of the actuator block are formed integrally in one laterally, extending piece loosely slidable vertically in the said groove at that end.

3. A multi-pole toggle switch as specified in claim 1 wherein:

said base includes a central longitudinally extending groove proximate the bottom thereof and below the level of the inner ends of said stationary contacts; and said actuator block includes a central, longitudinally extending, integral tongue slidably received in said groove, said tongue forming a movable, insulating barrier between said parallel, linear rows of contacts.

4. A multi-pole sub-miniature toggle switch of the type having an elongated switch housing and a toggle lever with a spring pressed plunger, the tip of said plunger arranged to move in a longitudinally extending path within said housing, said switch characterized by;

two parallel, linear, rows of stationary contacts within said housing, each row on an opposite side of said path and each row comprising two sets of said contacts each set including an inboard contact, an outboard contact and a see-saw support contact located centrally therebetween;

two parallel, linear rows of movable see-saw contacts, each row on an opposite side of said path and each see-saw contact seated in one of said stationary see-saw support contacts; and an elongated actuator block mounted to slide longitudinally within said housing, said block including two, linear, parallel rows of pads, each row on an opposite side of said path and each pad in sliding contact with one of said see-saw contacts to rock the same when said block is slidably moved;

said spring pressed plunger of said toggle lever being arranged to slide said block in said path while applying spring pressure thereto and thence to said pads and to said see-saw contacts.

5. A multi-pole sub-miniature toggle switch as specified in claim 4 wherein:

said elongated actuator block includes moving insulation barrier means extending between said linear parallel rows of stationary contacts and movable see-saw contacts to electrically isolate said rows of contacts and prevent short circuiting or electrical flash over.

6. A multi-pole sub-miniature toggle switch as specified in claim 4 wherein:

said housing includes a central longitudinal groove in the lower portion of the interior thereof; and said actuator block includes an integral, longitudinally extending, depending tongue slidably received in said groove;

said tongue and groove forming a moveable insulation barrier between said rows and a guide for said block.

* * * * *